US007264502B2

(12) United States Patent
Holland

(10) Patent No.: US 7,264,502 B2
(45) Date of Patent: Sep. 4, 2007

(54) POSTLESS COAXIAL COMPRESSION CONNECTOR

(76) Inventor: Michael Holland, 107 Via Del Cielo, Santa Barbara, CA (US) 93109

( * ) Notice: Subject to any disclaimer, the term of this patent is extended or adjusted under 35 U.S.C. 154(b) by 0 days.

(21) Appl. No.: 11/490,907

(22) Filed: Jul. 21, 2006

(65) Prior Publication Data

US 2006/0258181 A1 Nov. 16, 2006

Related U.S. Application Data

(63) Continuation-in-part of application No. 11/081,483, filed on Mar. 15, 2005, now Pat. No. 7,112,093.

(51) Int. Cl.
*H01R 9/05* (2006.01)

(52) U.S. Cl. ..... 439/578

(58) Field of Classification Search ..... 439/578, 439/322, 579

See application file for complete search history.

(56) References Cited

U.S. PATENT DOCUMENTS 6,217,383 B1 * 4/2001 Holland et al. ..... 439/578
6,361,364 B1 * 3/2002 Holland et al. ..... 439/578
6,425,782 B1 * 7/2002 Holland ..... 439/585
6,767,248 B1 * 7/2004 Hung ..... 439/578
2005/0260890 A1 * 11/2005 Holland ..... 439/578

* cited by examiner

*Primary Examiner*—Phuong Dinh
(74) *Attorney, Agent, or Firm*—Michael G. Petit

(57) ABSTRACT

A compression-type coaxial cable connector having a male adapter nut at the leading end thereof, a slotted body portion and a compression sleeve slidably attached to the body portion and forming the trailing end of the connector. The connector, and each of the components associated therewith, has an axial conduit coextensive with the length thereof. The prepared end of a coaxial cable is inserted into the trailing end of the axial conduit and advanced through the conduit into the body portion until the center conductor of the cable either extends into the adapter nut or is seized by a fixed seizing pin that extends through the leading end of the adapter nut, and the compression sleeve advanced over the body portion to complete the connection. The connector, which, unlike prior art connectors, lacks a center post, is easy to install and is suitable for low frequency (<~20 MHz) applications.

10 Claims, 5 Drawing Sheets

PRIOR ART

POSTLESS COAXIAL COMPRESSION CONNECTOR

This application is a continuation in part of U.S. Ser. No. 11,081,483, filed Mar. 15, 2005 now U.S. Pat. No. 7,112, 093, which has been allowed.

BACKGROUND OF THE INVENTION

1. Field of the Invention

The present invention relates to connectors for electrically connecting a coaxial cable to a female receiving port.

2. Prior Art

Coaxial cable connectors adapted to form a secure, electrically conductive connection between a coaxial cable and a receiving port such as, for example, RCA, BNC and Type F receiving ports, are well known in the art. Such prior art connectors are designed for transmission of high frequency signals and are disclosed and discussed, for example, in U.S. Pat. Nos. 5,024,605 to Ming-Hua, 4,280,749 to Hemmer, 4,593,964 to Forney, Jr. et al., 5,007,861 to Stirling, 5,073, 129 to Szegda and 5,651,699 to Holliday. U.S. Pat. No. 5,879,191 to Burris, and U.S. Pat. No. 6,217,383 to Holland discuss prior art efforts to provide a coaxial connector which is moisture-proof and minimizes radiative loss of signal from the cable. A radial compression type of coaxial cable connector of the type generally used today, is described in detail in U.S. Pat. No. 5,632,651 to Szegda, and the disclosure of Szegda '651 relating to radial compression coaxial cable connectors is incorporated herein by reference thereto While The innovative plethora of prior art connectors, some of which are disclosed above, provide improved moisture sealing and/or RF leakage characteristics, all have inherent limitations. The connectors must be designed to fit an exact cable size due to the fixed inner diameter of the ferrule or tubular barbed section into which the outer diameter of the dielectric layer of the cable must fit. The compression type connector designs mentioned above provide waterproofing, better high frequency performance, and higher holding forces on the cable for outdoor applications where the cable is also required to be a structural section of a system.

Another attractive feature of the compression type connector over former ring/crimp types is that the successful completion of the cable/connector installation is obvious after compression thus leading to a much lower level of installer/workmanship errors. Inasmuch as coaxial cable installers are equipped with tools and installation training for compression type connectors, the compression cable/connector attachment method has become popular as well beyond F types to include RCA and BNC type connectors used indoors on home theater equipment.

The present (prior art) compression connectors mentioned above rely upon an inward radial force of the compressing shell onto a fixed, hollow, cylindrical center post or ferrule into which the dielectric layer of the cable is inserted. The braid and jacket of the cable are compressed between the compression cylindrical ring and center post. The dimensions of the inner diameter of the center post must be precisely matched to the outer diameter of the dielectric layer to allow the cable to be inserted into the connector with a reasonably low force as well as to maintain a high holding force of the cable to connector after insertion and compressing. This limitation requires the connector dimensions to be designed to a specific cable dimension.

In the early stages of the higher performance connector development, there were only a few standard coaxial cables used such as RG-59 and RG-6 sizes so that one or two sizes of connectors were needed. An installer could use the outdoor models with water sealing for all applications. Presently, each of the RG-59 and 6 types have many variations with larger shields, teflon and fire retardant dielectrics and outer jackets for plenum use in buildings, softer jackets for flexible bends, and higher stranded shields for flexible use within home theater cabinets. In addition, the standard size specifications for the traditional RG-59 and 6 have changed so the cable designation has little meaning as to dimensions. Accordingly, it has become a requirement to make many sizes of connectors to fit all cables to meet the market needs. Attempts to make a universal design of the compression design have been limited or failures.

Prior art connectors rely on compression over the center post (alternatively referred to herein as "ferrule" or "tubular shank") for secure attachment of the connector to a coaxial cable. Accordingly, the barb on the tubular shank has a relatively high profile or angular pitch, which high profile makes it difficult to force the prepared end of a coaxial cable into the connector. Recent developments in building codes require that coaxial cable installed in particular locations within a structure, such as plenum areas, air return ducts and elevator shafts, have fire retardant jacketing materials. Such new jacketing materials have different physical properties than the standard coaxial cables previously used, such as elasticity, smoothness and thickness, which renders prior art connectors less than optimal for use therewith. There is a need for a coaxial cable connector that can be used with a variety of cable sizes for relatively low frequency applications.

SUMMARY

It is a first object of the invention to provide a coaxial cable connector that will allow a wide range of cable sizes and jacket materials to fit into the connector.

It is a further object of the invention to provide a coaxial cable connector that may be easily inserted over the prepared end of a coaxial connector with a minimum amount of force.

It is yet another object of the invention to provide a coaxial cable connector that meets the above-stated objectives and is of integral construction, having no separable parts.

It is still another object of the invention to provide a coaxial cable connector that can be securely attached to a variety of coaxial cables having a broad range of jacket thicknesses.

The present invention provides a compression-type coaxial cable connector meeting the objectives of the invention. The connector, in accordance with the present invention, is of integral construction and includes a cylindrical body portion that is preferably slotted, a matingly engaging interconnective interface disposed on a forward end of the body portion, and a compression sleeve slidingly attached to a rearward or trailing end of the body portion. The slotted body portion acts cooperatively with the compression sleeve to provide radial compression of the cable. The slotted body portion is a substantially cylindrical member having a leading or forward end, a trailing or rearward end and an axial conduit coextensive with the length thereof. The diameter of the conduit within the slotted body portion is stepped, having a smaller diameter in the leading end than in the trailing end. The trailing end of the conduit wall is slotted longitudinally and has a plurality of annular gripping ridges thereon.

The slotted trailing end of the slotted body portion has a plurality (preferably three) of annular grooves and one annular ridge on the outer surface thereof. The annular ridge on the outer surface of the body portion is disposed rearwardly of the first annular groove and forwardly of the second and third annular grooves. The third, rearwardmost annular groove provides means for attaching a compression sleeve to the aforesaid subassembly.

The compression sleeve is a substantially cylindrical member having a leading end, a trailing end and an axial conduit coextensive with the length thereof. The diameter of the conduit within the compression sleeve is stepped in three stages, with the largest diameter at the leading end of the conduit and the least diameter at the trailing end of the conduit. The leading end of the compression sleeve conduit has an annular ridge projecting radially inwardly from the conduit wall. When the leading end of the compression sleeve is advanced forwardly over the trailing end of the slotted body portion, the annular ridge within the conduit of the compression sleeve engages the third, rearwardmost groove on the slotted body portion to form a compressible coaxial cable connector assembly having integral construction.

Advancement of the compression sleeve over the body portion compresses the braided shielding cable between the compression sleeve gripping ridges within the conduit of the slotted body portion. Further advancement of the compression sleeve is terminated when the annular ridge within the conduit of the compression sleeve "snaps" into, and engages, the second, middle groove in the outer surface of the body portion. The cable is radially compressed where they underlie the gripping ridges, thereby providing a stable connection.

The present invention provides a universal coaxial cable connector which can fit a wide range of cables with both varying outer diameters, shields, and dielectric dimensions as required for a specific application. The specific application targeted is indoor use not requiring full water sealing and holding strength and lower frequencies (less than ~20 MHz) used for home theater and digital video products. The prior art coaxial cable connectors (i.e., connectors with a center post or ferrule) have been developed for CATV and satellite applications that require high electrical performance to 2 GHz whereas the targeted application requires electrical connector performance at much lower frequencies up to about 20 MHz.

The coaxial cable connector of the present invention uses the general design of prior art compression connectors, such as disclosed in US patents by Holland, Szegda, and Holliday (i.b.i.d.), that employ an internal cylindrical compression member compressed radially inward to effect connection of the cable to the connector, but without the use of the center post. This permits a wide range of cables with outer diameters ranging from 3-6 mm to be attached to a single connector. The coaxial cable connectors of the present invention can be made for use with F-type, BNC, RCA, MCX, or SMA receiving ports. Accordingly, the adapter nut on the present connector, which matingly engages a female receptacle, may be either rotatably or nonrotatably attached to the leading end of the connector body, the choice depending on the application. The limited moisture sealing ability, the slightly reduced holding force and the loss in signal transmission performance at ultra high frequency inherent in the present coaxial cable connector are acceptable tradeoffs for a connector that requires less insertion force and accommodates a wide range of cable sizes.

The features of the invention believed to be novel are set forth with particularity in the appended claims. However the invention itself, both as to organization and method of operation, together with further objects and advantages thereof may be best be understood by reference to the following description taken in conjunction with the accompanying drawings in which:

DESCRIPTION OF THE PREFERRED EMBODIMENTS

Figure 1:
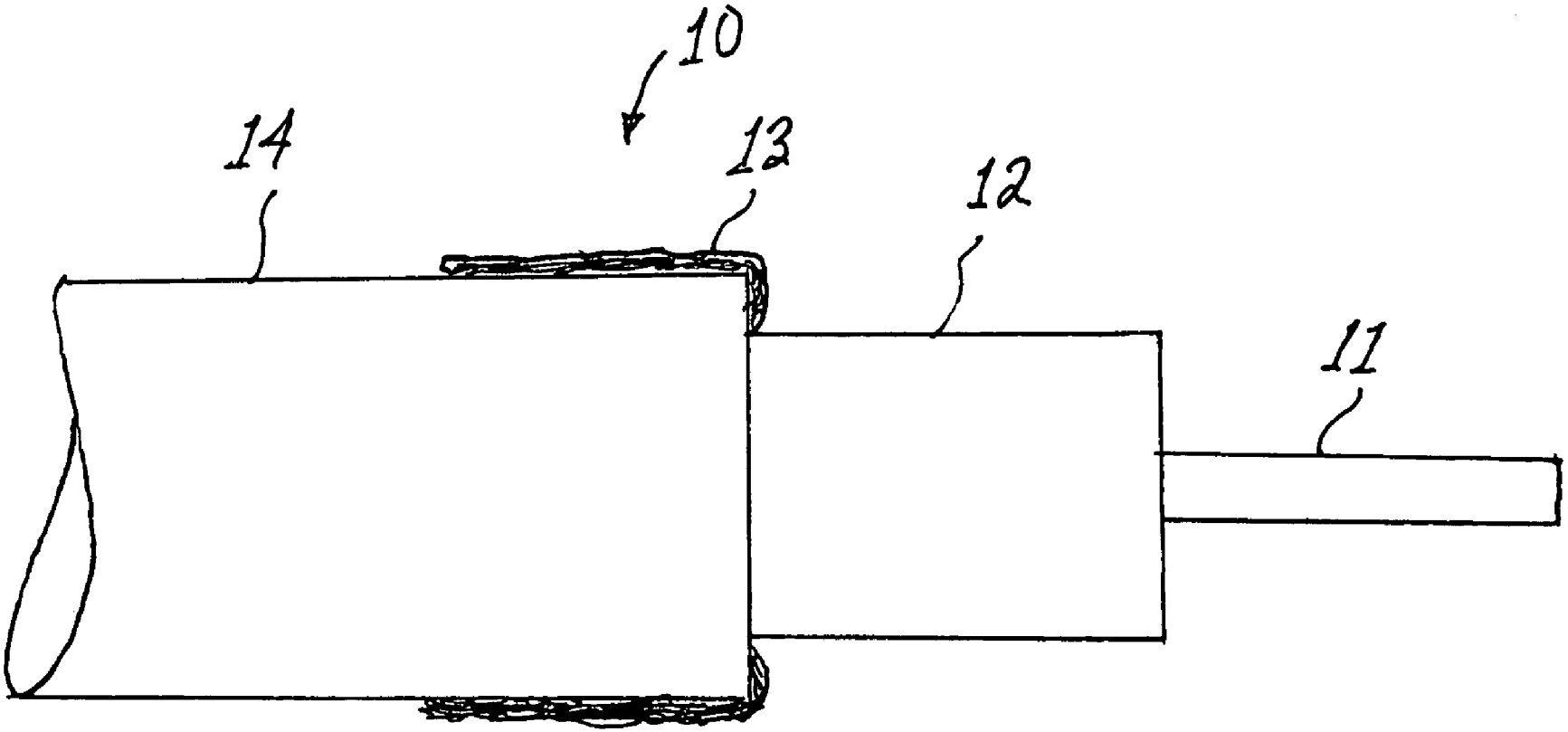
PRIOR ART Figure 1
FIG. 1 is an elevational view showing the prepared end of a coaxial cable with the conductive braid folded back to overlie a portion of the protective jacket.

Turning now to FIG. 1, in accordance with the prior art, the prepared (i.e., stripped) end of a coaxial cable 10 is shown in elevational view. Prior to coupling a coaxial cable to a connector, the end of the cable to receive the connector must first be prepared. A cutting tool (not shown) is used by an installer to expose a portion of the central conductor 11, a length of the dielectric core 12 and a conductive (grounding) braid 13, as shown in FIG. 1. The respective lengths of each of the elements comprising the coaxial cable 10 that are exposed by the cutting tool are in accordance with industry standards. Following exposure of the conductive braid 13, the exposed portion of conductive braid 13 is flared and folded back to overlie the protective jacket 14 as shown. The coaxial cable 10 may further include one or more layers of an electrically conductive foil underlying the conductive braid. The thickness of the conductive braid 13 and outer diameter of the jacket 14 may vary, depending on the manufacturer, and require the application of different amounts of force by the installer in order to correctly position the cable end within a prior art connector prior to attachment of a connector to the cable 10.

Figure 7:
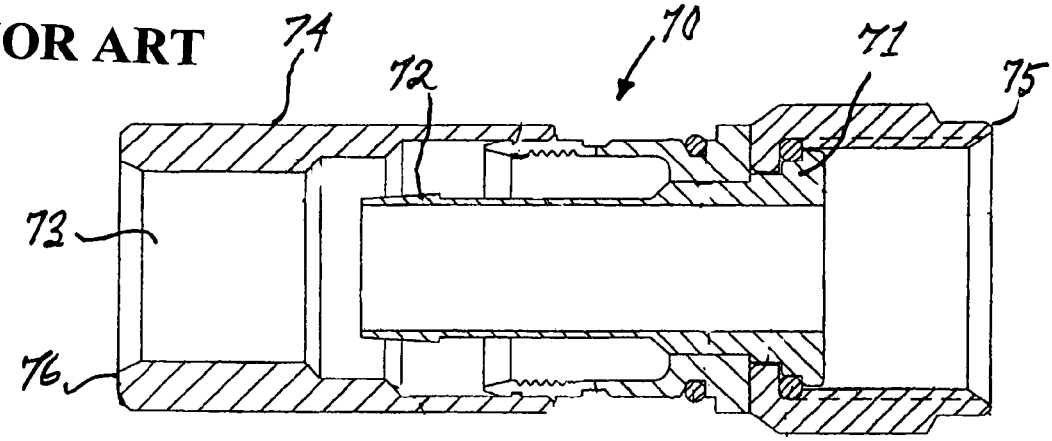
Figure 7 PRIOR ART
FIG. 7 is a cross-sectional view of a prior art coaxial cable connector having a center post or ferrule disposed in the axial conduit thereof, prior to the insertion of the coaxial cable thereinto.
Figure 8:
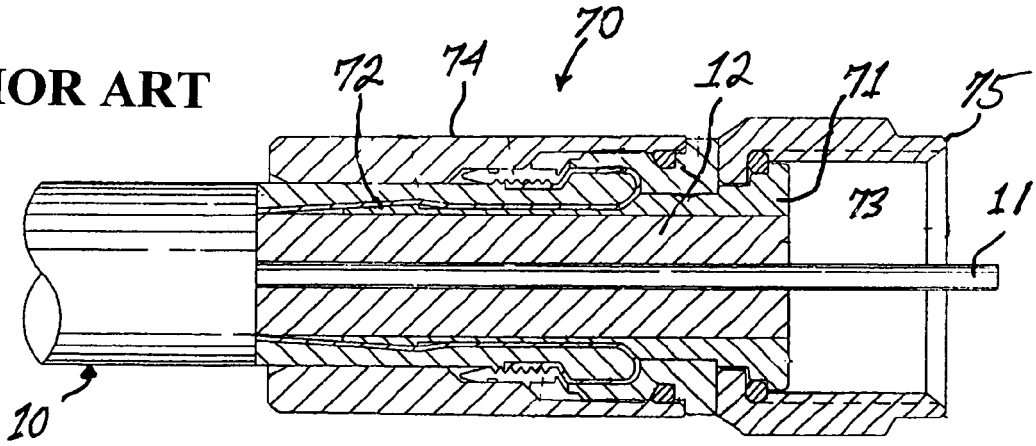
FIG. 8 is a longitudinal cross-sectional view of the (ferruled) prior art connector of FIG. 7 with a coaxial cable inserted thereinto.

In order to appreciate the advantages of the present invention, it is helpful to consider an exemplary prior art coaxial cable connector such as illustrated in FIGS. 7 and 8. The prior art connector 70 includes a center post or ferrule 71, usually having a barbed tip 72 thereon, disposed concentrically within the axial conduit 73 of the connector 70. Many of the prior art connectors 70 include a compression sleeve 74 that is operable for securely attaching the connector to the prepared end of a coaxial when the compression sleeve is forced to advance toward the leading end 75 of the connector as shown in FIG. 8. In order to install the connector 70 on the prepared end of a coaxial cable, the prepared end of the cable is inserted into the trailing end 76 of the axial conduit 73 and advanced thereinto until the barbed trailing end 72 of the center post 71 is forced between the dielectric layer and the overlying braided shielding of the cable. The cable is further advanced into the conduit 73 until the center conductor 11 extends through the leading end 75 of the connector 70. The outer diameter of the dielectric layer 12 must be substantially identical to the inner diameter of the center post 71. Accordingly, the dimensions of the cable and connector must be carefully matched. This requirement makes it difficult to force the cable into the connector and renders the connector useless if there is a dimensional mismatch between the cable and connector.

Artisans have long appreciated the necessity of a center post 71 in coaxial cable connectors that are employed for conducting high frequency signals when a compression sleeve is used to secure the cable to the connector. Without the center post, compression will change the thickness of the dielectric layer between the center conductor of the cable and the braided shielding. The change in spacing between the conductor and braided shielding causes impedance changes that significantly degrade signal quality at high frequencies (~2 GHz). The effect of compression of the dielectric layer on the degradation of signal quality is, however, much less at lower frequencies (<~20 MHz).

Figure 2:
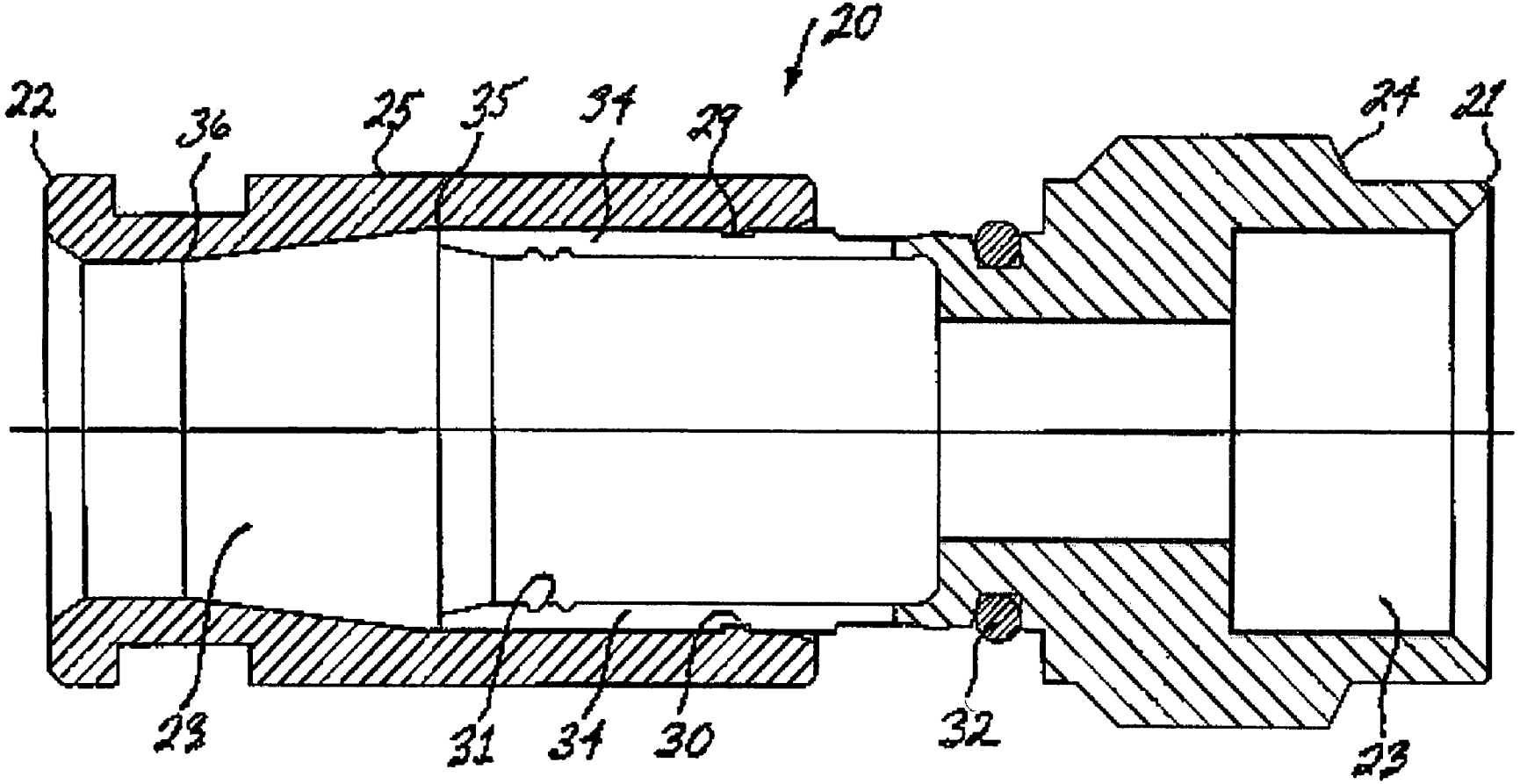
FIG. 2 is a cross-sectional view of a coaxial cable connector in accordance with the present invention prior to the insertion of the coaxial cable thereinto.

A postless coaxial cable-connector assembly in accordance with a slotted embodiment of the present invention is shown in cross-sectional view in FIG. 2. The connector 20 is a generally cylindrical member having a leading end 21, a trailing end 22 and an axial lumen 23 coextensive with the length thereof and having integral construction. An adapter nut 24 forms the leading end of the connector 20 and a compression sleeve 25 forms the trailing end. The leading end of adapter nut 24 is adapted to matingly engage a RCA, MCX, or SMA receiving port. Accordingly, the adapter nut on the present connector, which matingly engages a female receptacle, is nonrotatably attached to the leading end of the connector body. The trailing end of the adaptor nut 24 forms a tubular slotted body portion having an outer diameter dimensioned to fit snugly within the axial lumen of the leading end of the compression sleeve 25. The compression sleeve 25 has an annular ridge 29 on the inner cylindrical surface thereof which matingly engages an annular groove 30 in the outer surface of the (slotted) body portion forming the trailing end of the adaptor nut 24.

Figure 3:
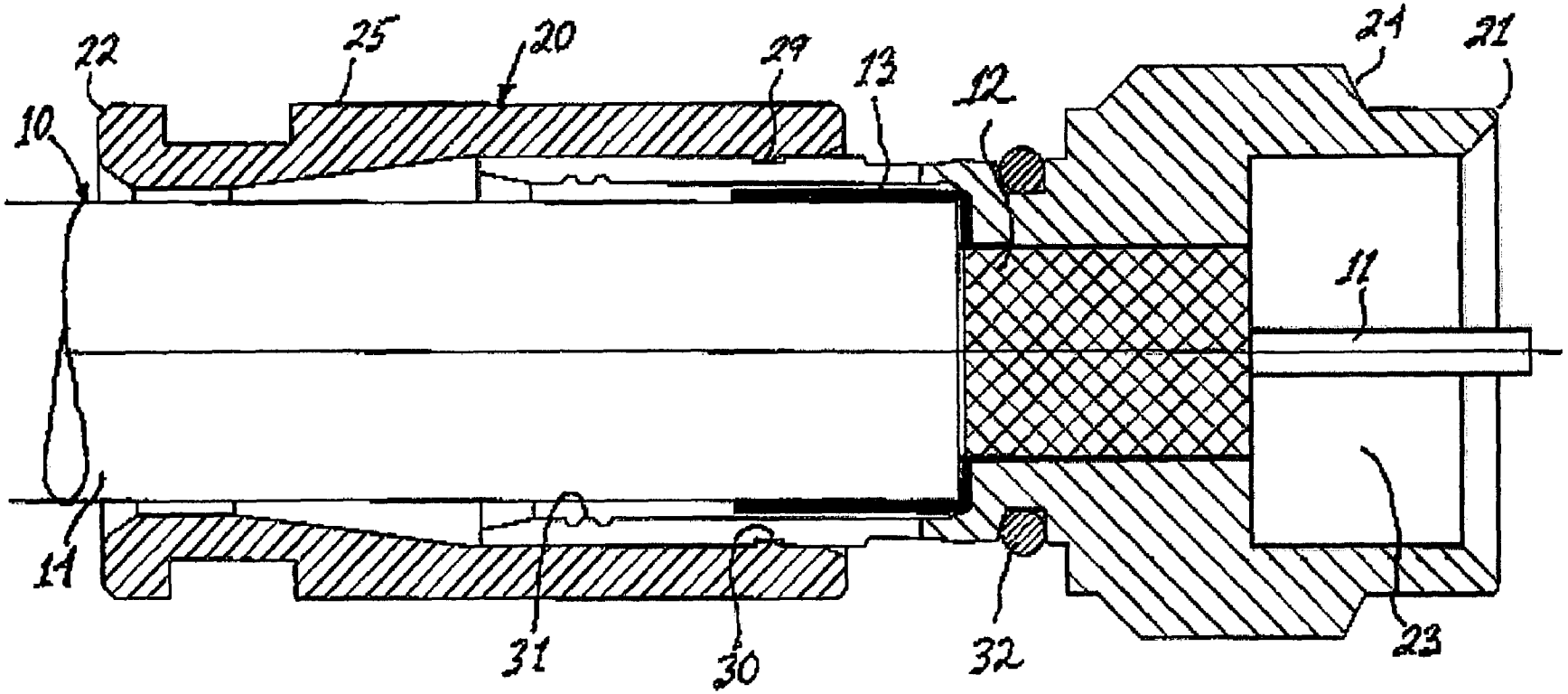
FIG. 3 is a cross-sectional view of the coaxial cable connector in accordance with FIG. 2, shown with the prepared end of a coaxial cable inserted thereinto and prior to advancement of the compression sleeve.
Figure 4:
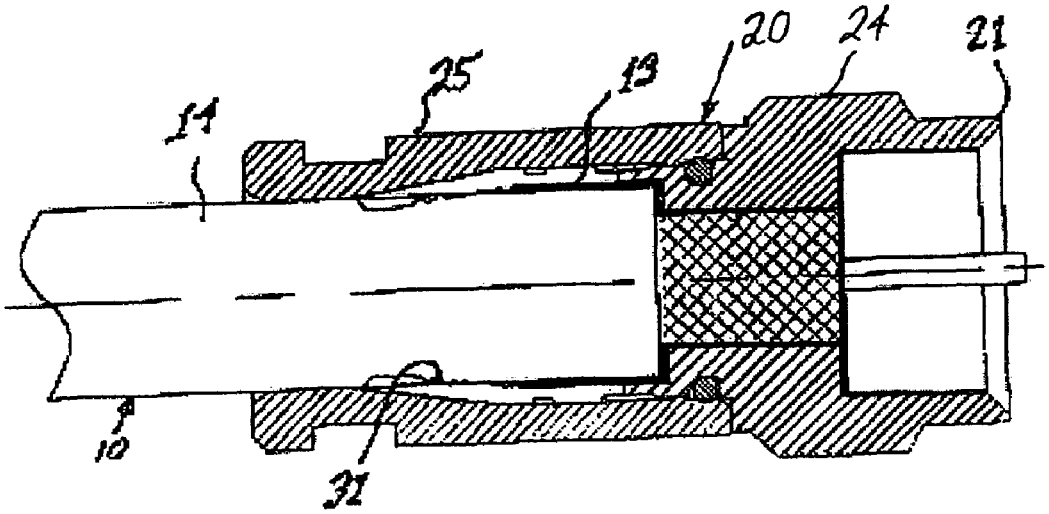
FIG. 4 is a cross-sectional view of the coaxial cable connector in accordance with FIG. 3, with the compression sleeve advanced to lockingly engage the body portion of the connector to securely attach the connector to the prepared end of the coaxial cable.

FIG. 3 is a cross-sectional view of the coaxial cable connector 20 illustrated in FIG. 2, with the prepared end of a coaxial cable 10 inserted thereinto and prior to advancement of the compression sleeve 25 toward the leading end 21 of the connector 20. FIG. 4 is a cross-sectional view of the coaxial cable connector 20 in accordance with FIG. 3 with the compression sleeve 25 advanced toward the leading end 21 of the connector to compress and lockingly engage the body portion of the connector to securely attach the connector to the prepared end of the coaxial cable. The compression sleeve 25 is a cylindrical member having an axial conduit 23 (FIG. 2) coextensive with the length thereof, the axial conduit 23 having a conical diameter within the compression sleeve, the largest diameter of the conical diameter indicated at numeral 35 (FIG. 2), the conical diameter decreasing toward the trailing end 22 to a point indicated at numeral 36. The compression sleeve 25 includes an annular ridge 29 disposed circumferentially on the conduit wall rearwardly of the leading end thereof. When the leading end of the compression sleeve is inserted and advanced over the trailing end of the slotted body portion 26 of adaptor nut 24, the slots 34 on the slotted body portion enable the trailing end thereof to be elastically compressed radially inwardly by the tapered inner diameter of the compression sleeve 25 when the compression sleeve is advanced. Further facile advancement of the compression sleeve over the slotted body portion is terminated when the annular ridge 29 engages the rearmost trailing groove 30 on the slotted body portion. The engagement between the ridge 29 and trailing groove 30 prevents retraction of the compression sleeve from engagement with the slotted body portion but permits further advancement of the compression sleeve over the slotted body portion when sufficient force is applied, as, for example, by an installer's compression tool.

In order to attach the connector 20 to a coaxial cable 10, the prepared end of the coaxial cable, as illustrated in FIG. 1, is inserted into the trailing end 22 of the connector conduit 23 and advanced thereinto until the central conductor 11 projects from the leading end 21 of the connector (or is entrapped within the axial conduit of a seizing pin axially affixed to the adapter nut as is described below). The compression sleeve 25 is then further advanced over the slotted body portion using a suitable compression tool. As the compression sleeve advances, the beveled conical diameter within the axial conduit of the compression sleeve progressively urges the trailing end of the slotted body portion inwardly against the braided shield 13, compressing it against the underlying cable. At the same time, the gripping ridge(s) 31 are forced radially inwardly to grasp the cable jacket as shown in FIG. 4. Compression of the connector is terminated when the annular ridge 29 "snaps" into and engages the forward annular groove 36 in the slotted body portion.

Figure 5:
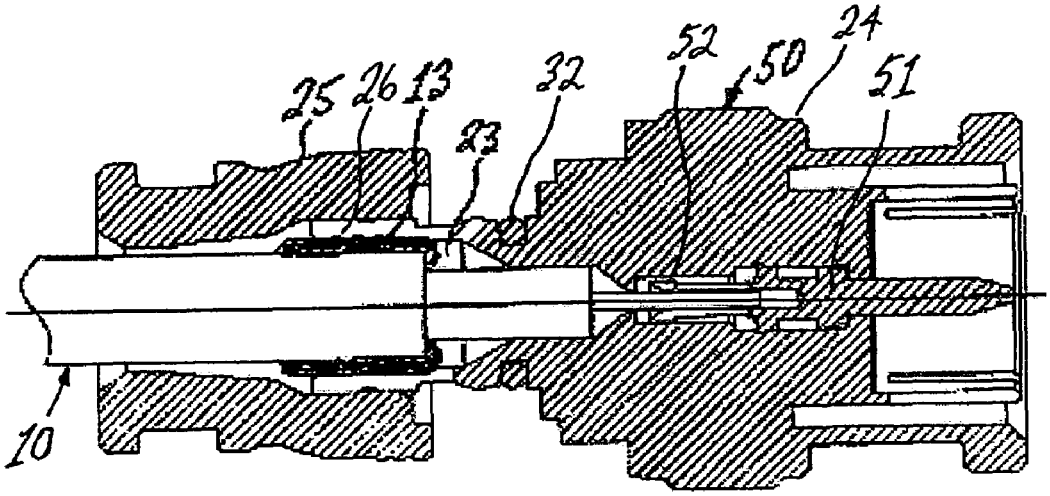
FIG. 5 is a cross-sectional view of the coaxial cable connector in accordance with a seizing pin embodiment of the connector, shown with the prepared end of a coaxial cable inserted into the connector until the center conductor of the cable is seized by a seizing pin and prior to advancement of the compression sleeve.
Figure 6:
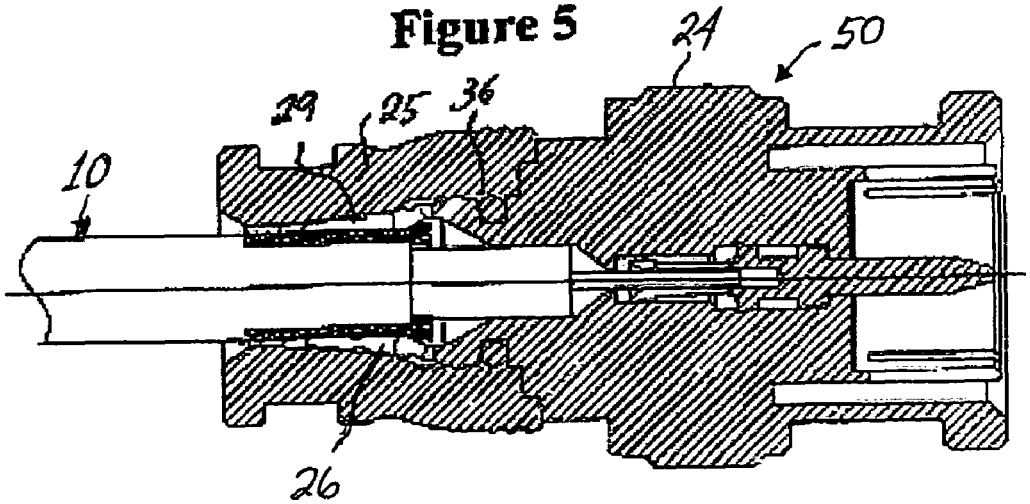
FIG. 6 is a cross-sectional view of the seizing embodiment of the coaxial cable connector illustrated in FIG. 5, with the compression sleeve advanced to lockingly engage the body portion of the connector to securely attach the connector to the prepared end of the coaxial cable.

Referring now to FIGS. 5 and 6, a seizing pin embodiment of a connector having a seizing pin 51 disposed in the axial conduit and integral with the connector is illustrated at numeral 50. FIG. 5 is a cross-sectional view of the coaxial cable connector 50 in accordance with the seizing pin embodiment of the connector, with the prepared end of a coaxial cable 10 inserted into the axial conduit 23 in the connector 50 until the center conductor 11 of the cable is seized by a seizing pin 51 having a hollow trailing end 52. FIG. 6 is a cross-sectional view of the seizing embodiment of the coaxial cable connector 50 illustrated in FIG. 5, with the compression sleeve 25 advanced to lockingly engage the body portion 26 of the connector to securely attach the connector to the prepared end of the coaxial cable.

With continued reference to FIGS. 5 and 6, the prepared end of the cable 10 is inserted into the axial conduit 23 in the trailing end 22 of the connector 20 and advanced toward the leading end 21 until the central conductor 11 is correctly positioned for engagement with a female receptacle (not shown). The adapter nut 24 includes a center conductor receiving pin 51 axially mounted therein and electrically insulated from the adapter nut. The receiving pin has a central, preferably tapered axial conduit in the trailing end thereof dimensioned to snugly receive the center conductor. The receiving pin is particularly suitable when the connector 50 is intended for use with cables having a thin or stranded center conductor wherein it is difficult to introduce the center conductor directly into the female receptacle. Since the connector 50 lacks a center post, the cable 10 slides into the connector 50 with minimum resistance. The pair of slots 34 in the trailing end of the body portion 26 enable an installer to view the dielectric layer 12 of the cable (FIG. 1) as it advances through the axial conduit 23 and enables the trailing end of the body portion to be compressed radially inwardly when the compression sleeve 25 is advanced. The exposed portion of the conductive braid 13 of the cable 10 is folded back and compressed between the cable jacket 14 and inner surface of the trailing end of the slotted body portion 26 when the compression sleeve 25 is forced toward the leading end 21 of the connector 20. The inner surface of the connector body portion 26 has at least one and more preferably a plurality of ridges 31 thereon that serve to securely hold the cable when the cable is compressed by the advancement of the compression sleeve over the slotted body portion. The cable compression point underlies gripping ridges 31 within the trailing end of the slotted body portion. The connector 50 may optionally include an "O" ring 32 which provides a moisture seal between the slotted body portion 26 and the compression sleeve 25.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What I claim is:

1. A coaxial cable connector having an axial conduit coextensive with a length thereof, the connector being operable for coupling an electrically conductive pin attached to a center conductor of a coaxial cable to a receiving port to provide an electrical connection between the center conductor and the receiving port, said connector consisting essentially of: (a) a cylindrical body portion having a leading end and a trailing end and a central conduit dimensioned to receive the coaxial cable; (b) an adapter nut nonrotatably attached to said leading end of said body portion, said adapter nut having an axial conduit adapted to receive a leading end of the conductive pin therewithin, said adapter nut being operable for matingly engaging the receiving port; and (c) a cylindrical compression sleeve slidably attached to said trailing end of said body portion.

2. The coaxial cable connector of claim 1 wherein said body portion has at least one slot in a trailing end thereof.

3. The coaxial cable connector of claim 2 wherein an inner diameter of said compression sleeve adjacent a trailing end thereof is less than said inner diameter at a leading end of said compression sleeve.

4. The coaxial cable connector of claim 3 wherein said compression sleeve has an annular ridge on an inner surface thereof and wherein said body portion has a forward annular locking groove and a rearward annular locking groove on an outer surface thereof and wherein said annular ridge engages said rearward annular locking groove on said outer surface of said slotted body portion to slidably attach said compression sleeve to said body portion.

5. The coaxial cable connector of claim 4 wherein when said compression sleeve is advanced toward said leading end of said body portion, said trailing end of said body portion is forced radially inwardly and said annular ridge on said inner surface of said compression sleeve lockingly engages said forward locking groove on said outer surface of said body portion.

6. A coaxial cable connector having an axial conduit coextensive with a trailing portion thereof, the connector being operable for coupling an end of a coaxial cable having a center conductor to a receiving port to provide an electrical connection between the center conductor of the coaxial cable and the receiving port, said connector consisting essentially of: (a) a cylindrical body portion having a leading end and a trailing end; (b) an adapter nut nonrotatably attached to said leading end of said body portion, said adapter nut being operable for matingly engaging the receiving port; and (c) a cylindrical compression sleeve having a cylindrical axial conduit with an inner diameter therewithin slidably attached to said trailing end of said body portion.

7. The coaxial cable connector of claim 6 wherein said body portion has at least one slot in a trailing end thereof.

8. The coaxial cable connector of claim 7 wherein said inner diameter of said axial conduit within said compression sleeve adjacent a trailing end thereof is less than said inner diameter at a leading end of said axial conduit within said compression sleeve.

9. The coaxial cable connector of claim 8 wherein said compression sleeve has an annular ridge on an inner surface thereof and wherein said body portion has a forward annular locking groove and a rearward annular locking groove on an outer surface thereof and wherein said annular ridge engages said rearward annular locking groove on said outer surface of said slotted body portion to slidably attach said compression sleeve to said body portion.

10. The coaxial cable connector of claim 9 wherein when said compression sleeve is advanced toward said leading end of said body portion, said trailing end of said body portion is forced radially inwardly and said annular ridge on said inner surface of said compression sleeve lockingly engages said forward locking groove on said outer surface of said body portion.

* * * * *